US008992383B2

(12) United States Patent
Bilang

(10) Patent No.: US 8,992,383 B2
(45) Date of Patent: Mar. 31, 2015

(54) EXERCISE APPARATUS AND ALPHANUMERIC KEYBOARD INTENDED FOR SUCH AN EXERCISE APPARATUS

(76) Inventor: Eric Bilang, Madetswil (CH)

( * ) Notice: Subject to any disclaimer, the term of this patent is extended or adjusted under 35 U.S.C. 154(b) by 114 days.

(21) Appl. No.: 13/806,331

(22) PCT Filed: Jun. 6, 2011

(86) PCT No.: PCT/CH2011/000133

§ 371 (c)(1),
(2), (4) Date: Mar. 4, 2013

(87) PCT Pub. No.: WO2011/160245

PCT Pub. Date: Dec. 29, 2011

(65) Prior Publication Data

US 2013/0210576 A1 Aug. 15, 2013

(30) Foreign Application Priority Data

Jun. 21, 2010 (CH) ..... 991/10

(51) Int. Cl.

| | |
|---|---|
| ***A63B 24/00*** | (2006.01) |
| ***A63B 22/02*** | (2006.01) |
| ***A63B 22/06*** | (2006.01) |
| ***A63B 71/06*** | (2006.01) |

(52) U.S. Cl.

CPC ..... *A63B 24/00* (2013.01); *A63B 22/02* (2013.01); *A63B 22/0605* (2013.01); *A63B 71/0619* (2013.01); *A63B 2071/0658* (2013.01); *Y10S 482/901* (2013.01)

USPC ..... 482/1; 482/8; 482/9; 482/901; 482/92; 482/148

(58) Field of Classification Search

USPC ..... 482/1–9, 51, 54, 57, 900–902; 434/247

See application file for complete search history.

(56) References Cited

U.S. PATENT DOCUMENTS

| | | | | |
|---|---|---|---|---|
| 5,314,391 | A | 5/1994 | Potash et al. | |
| 5,984,839 | A | 11/1999 | Corkum | |
| 7,044,891 | B1 | 5/2006 | Rivera | |
| 7,938,027 | B2 * | 5/2011 | Topel et al. | 73/862.53 |
| 2002/0043909 | A1 * | 4/2002 | Nielsen | 312/237 |
| 2003/0008752 | A1 * | 1/2003 | Hsu | 482/55 |

(Continued)

FOREIGN PATENT DOCUMENTS

| | | |
|---|---|---|
| CN | 201049171 | 4/2008 |
| KR | 20030010906 | 2/2003 |

(Continued)

OTHER PUBLICATIONS

International Search Report mailed Aug. 25, 2011.

*Primary Examiner* — Glenn Richman

(74) *Attorney, Agent, or Firm* — Cooper & Dunham LLP

(57) ABSTRACT

The invention relates to an exercise apparatus (1), which has a running surface or a sitting surface (9), provided with a holding arrangement for the exercising person. The holding arrangement has a crossbar (6). In order for the exercising person to be able to carry out writing work on a computer (20) during exercise, a keyboard (7, 8) is arranged in such a way that the keyboard lies on the side of the bar (6) facing away from the running surface or sitting surface (9). In particular, the keyboard is also tilted downward. Said arrangement of the keyboard enables physical exercise and writing work to be carried out at the same time.

16 Claims, 4 Drawing Sheets

(56) References Cited

U.S. PATENT DOCUMENTS

| | | | | |
|---|---|---|---|---|
| 2006/0205566 | A1 | 9/2006 | Watterson et al. | |
| 2006/0247109 | A1 | 11/2006 | Powell | |
| 2007/0117680 | A1* | 5/2007 | Neff et al. | 482/8 |
| 2007/0265146 | A1* | 11/2007 | Kowalczewski et al. | 482/92 |
| 2007/0287597 | A1 | 12/2007 | Cameron | |
| 2009/0138637 | A1 | 5/2009 | Hargreaves et al. | |
| 2011/0118086 | A1 | 5/2011 | Radow et al. | |

FOREIGN PATENT DOCUMENTS

| | | |
|---|---|---|
| WO | 01/12269 | 2/2001 |
| WO | 2010019644 | 2/2010 |

* cited by examiner

EXERCISE APPARATUS AND ALPHANUMERIC KEYBOARD INTENDED FOR SUCH AN EXERCISE APPARATUS

CROSS-REFERENCE TO RELATED APPLICATIONS

This application is a §371 national stage of PCT International Application No. PCT/CH2011/000133, filed Jun. 6, 2011, which claims priority to Swiss Patent Application No. 991/10, filed Jun. 21, 2010, the entire contents of each of which are hereby incorporated by reference into this application.

TECHNICAL FIELD

The invention relates to an exercise apparatus having a support frame for arranging the exercise apparatus on a floor surface, having an exercising arrangement arranged on the support frame which has a sitting surface for use by a sitting person or a running surface for use by a standing person, and having a holding arrangement which has a bar which is arranged at right angles to the longitudinal direction of the exercise apparatus and is intended and arranged for supporting the hands of the person exercising on the exercise apparatus, and having an alphanumeric keyboard equipped for clerical work. Further, as claimed in claim in 9, the invention relates to an alphanumeric keyboard, in particular a QWERTZ or QWERTY keyboard, which is intended and designed for arranging on such an exercise apparatus. Further, as claimed in claim 12, the invention relates to the use of an alphanumeric keyboard for carrying out clerical work while exercising on an exercise apparatus.

PRIOR ART

Exercise apparatuses, which along with an exercising arrangement which is designed as an exercise bicycle or treadmill also have a keyboard for operating a computer, are known. For example, Chinese patent specification CN 201049171 Y shows an exercise bicycle with which a support table for an alphanumeric keyboard and a computer mouse is provided instead of a bicycle handlebar, and a treadmill which also has a support table for such a keyboard and the mouse. American patent specification US 2003/0008752 A1 likewise shows an exercise bicycle with a mounting for an alphanumeric computer keyboard instead of the bicycle handlebar. American patent specification U.S. 2006/0247109 A1 shows a treadmill with a worktable which has a sliding shelf for an alphanumeric computer keyboard. The full-fledged alphanumeric keyboards with these exercise apparatuses can be equipped with all the letter and number keys necessary for clerical work, and therefore basically allow work to be carried out on the computer during physical exercise. A treadmill is disclosed in U.S. Pat. No. 5,984,839 A, with which special key arrangements or normal keyboards are provided on mounting bars located to the side of the treadmill. However, with all the exercise apparatuses mentioned, working on the keyboard to carry out clerical work while exercising is not optimal. An exercise apparatus in the form of a bicycle which has a media playback device in front of the handlebar is disclosed in U.S. Pat. No. 7,044,891. No clerical work can be carried out with this exercise apparatus. International patent application WO 01/12269 A1 likewise shows an exercise bicycle with a playback device, with which a keyboard can also be provided. A two-part keyboard is disclosed in American patent application U.S. 2009/0138637 A1 and two-part keyboards are also commercially available. They are intended to provide improved ergonomics in normal computer workstations.

SUMMARY OF THE INVENTION

The invention is based on the object of creating an improved exercise apparatus with computer work facility which, in particular, significantly improves the carrying out of clerical work on such an exercise apparatus.

With the exercise apparatus of the kind mentioned in the introduction, this is achieved in that the keyboard is arranged on the holding arrangement on the side of the bar facing away from the sitting surface or the running surface.

On the one hand, this arrangement of the keyboard allows the user to support himself on the bar with the heels of the hand while exercising which allows efficient exercising, and, on the other, to operate the keys of the keyboard with the fingers in the usual way when carrying out clerical work from this support position. Clerical work can therefore be carried out and the computer used in a very efficient manner during exercise units. In particular, the writing of or replying to e-mails can be carried out in this way during an exercise session. Also, all other work which is carried out on the computer using an alphanumeric keyboard is possible in this way while exercising.

In a preferred embodiment, the keyboard is arranged on the holding arrangement so that its height can be adjusted, which enables it to be adapted to suit the individual position of the hands on the bar while exercising. Further, it is preferred that the keyboard is arranged inclined with respect to the horizontal in such a way that the spacebar comes to lie higher above the floor surface than the QWERT keys of the keyboard, and also that the keyboard is arranged on the holding arrangement so that its inclination can be adjusted. This also enables an optimum positioning of the keyboard to the position of the hands when exercising.

Further, it is preferred that the keyboard is formed from keyboard parts, in particular keyboard halves, which each accommodate a portion of the keys and which are arranged separately from one another on the holding arrangement. On the one hand, this results in an arrangement of the keys which is matched to the position of the hands when exercising. Further, an advantageous mounting facility for the keyboard is provided when a column of the holding arrangement on the exercise apparatus ascends above the bar. The keyboard halves can then be arranged on both sides of the column. It is preferred when an input device in the form of a touchpad or trackball is also arranged on the side of the bar facing away from the sitting surface or running surface.

A design of the exercise apparatus in the form of a domestic exercise bicycle which has a saddle as the sitting surface and pedals is preferred. In another embodiment, the exercise apparatus is provided with a treadmill.

The invention further relates to an alphanumeric keyboard for clerical work. This is provided with a mounting arrangement which, on an exercise apparatus with a bar for supporting the hands of the person exercising, is designed in such a way that the keyboard rests on the side of the bar facing away from the sitting surface or running surface of the exercise apparatus and is mounted so that its height and inclination can be adjusted. At the same time, the keyboard is preferably provided with clamping jaws which allow it to be mounted directly on the bar by partially encompassing said bar. In particular, the keyboard is designed in two parts which results in the advantages stated above. Each keyboard part is then preferably provided with clamping jaws.

The invention further relates to a use of an alphanumeric keyboard as claimed in claim 12. This results in the advantages mentioned above.

BRIEF DESCRIPTION OF THE DRAWINGS

Exemplary embodiments of the invention are described in more detail below with reference to the drawings. In the drawings

WAYS OF IMPLEMENTING THE INVENTION

Figure 1:
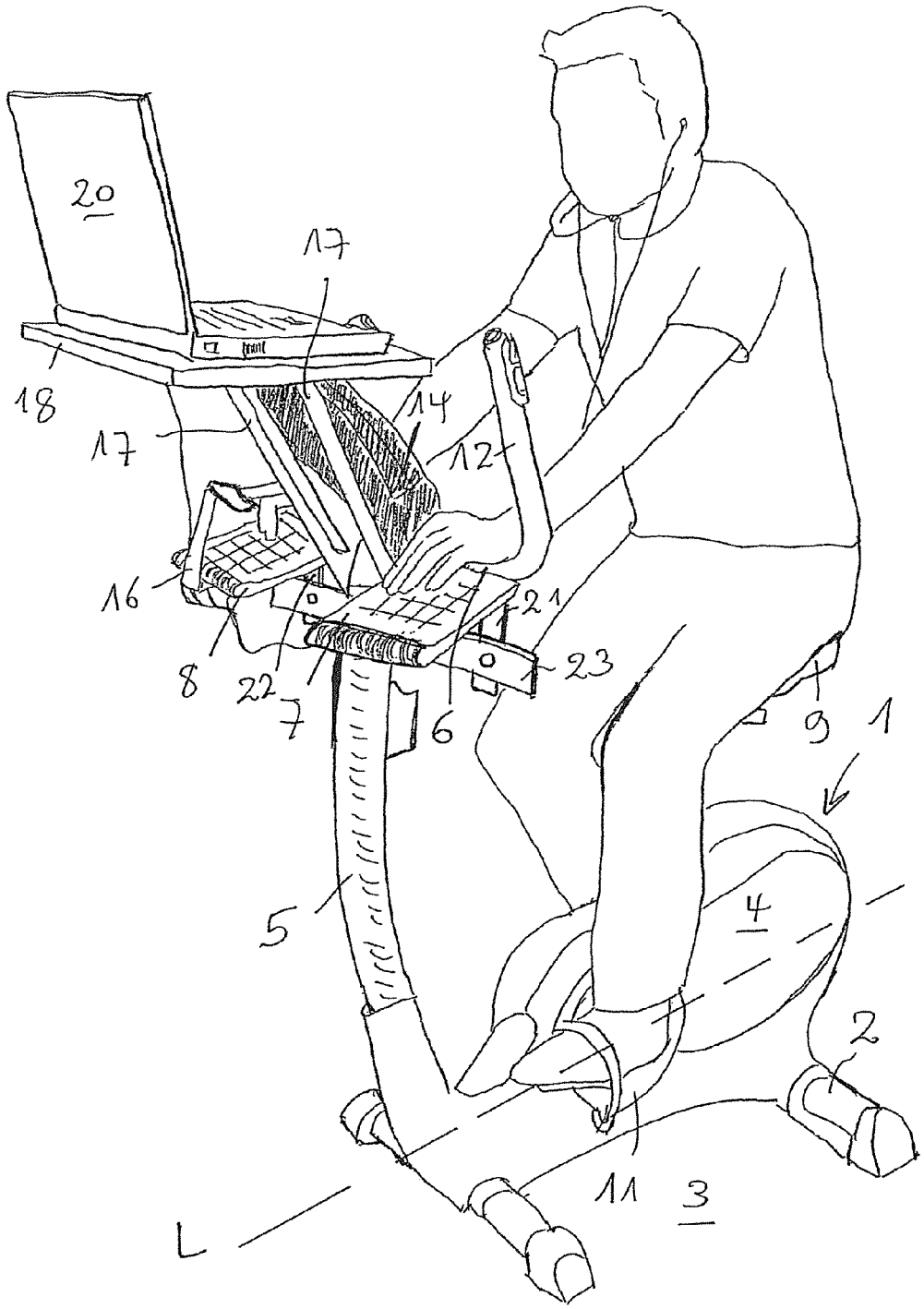
FIG. 1 shows a diagrammatic view of an exercising arrangement in the form of a domestic exercise bicycle.
Figure 2:
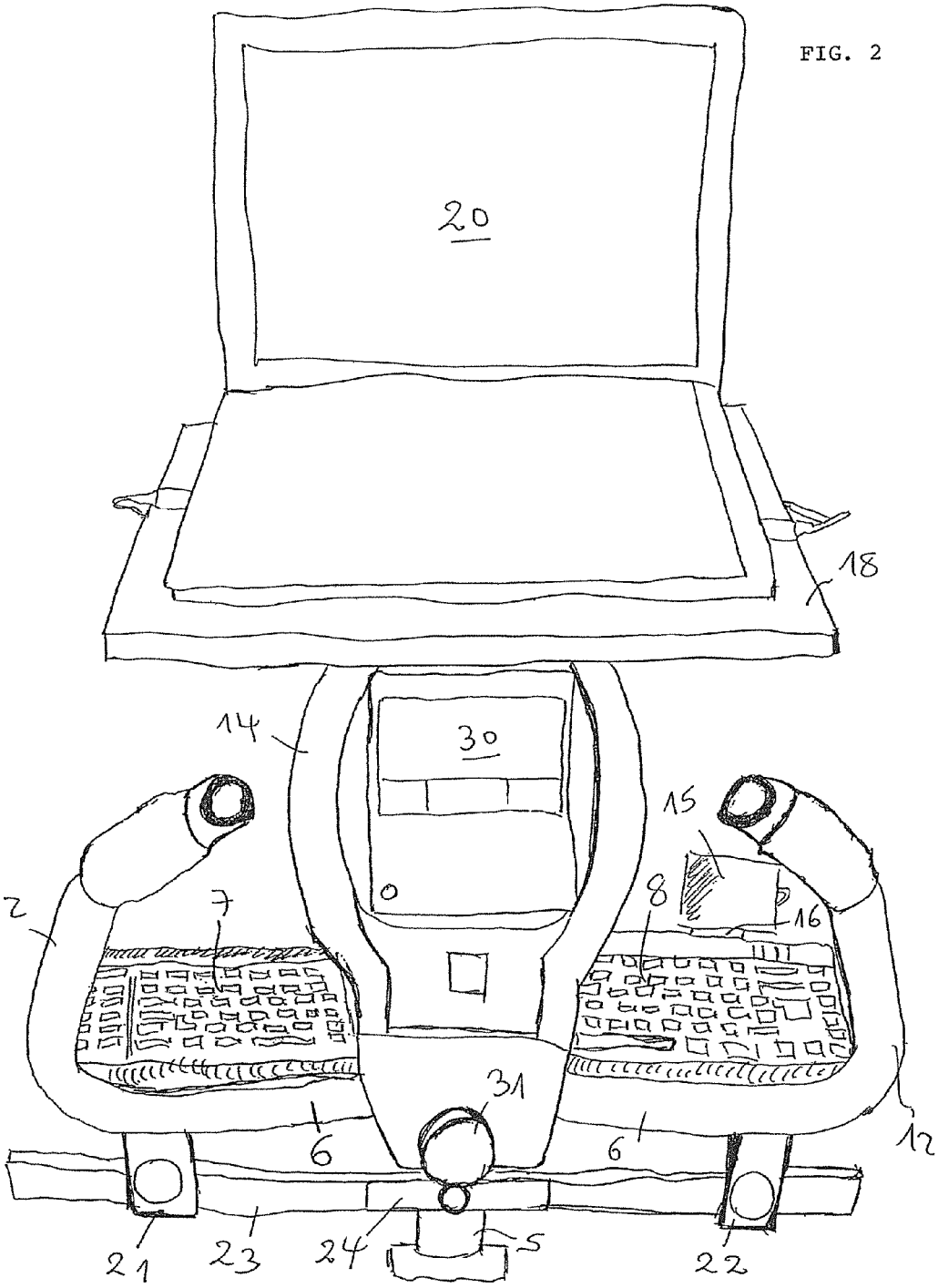
FIG. 2 shows a view from the sitting surface on the bar of the holding arrangement.

FIGS. 1 and 2 and also 3 show a preferred embodiment of the exercise apparatus. They also show an embodiment of the keyboard with two keyboard parts which can be fixed to an exercise apparatus. The exercise apparatus 1, which has a support frame 2 with which it can be placed on a floor 3, is shown. The exercise apparatus 1 has an exercising unit 4, which here is designed in the form of a domestic exercise bicycle with a sitting surface 9. In an alternative embodiment, the exercise apparatus can be a treadmill. In the usual way, this can have side handrails which delimit the treadmill and form a holding facility for the person exercising. Common to both embodiments is that the exercise apparatus has a holding arrangement 5, 6 which comprises an upward-pointing column 5 on the support frame 2 and a crossbar 6. The bar 6 is arranged at right angles to the longitudinal direction L of the exercise apparatus in such a way that the person exercising can support the heels of his hands on the bar 6. This is known particularly with domestic exercise bicycles, and with these the bar 6 forms the "handlebar" of the bicycle.

Further, a keyboard, which in this example is a two-part keyboard 7, 8 with two keyboard parts, is arranged on the exercise apparatus. At the same time, the keyboard is arranged so that it comes to lie on the side of the bar 6 facing away from the exercising arrangement 4. As shown, this enables the person exercising, whether he is now sitting on the sitting surface 9 or walking on a treadmill (not shown), to support the heels of his hands on the bar 6. On the one hand, this enables meaningful exercise, as the person can assume a position which is suitable for the exercise. On the other hand, this arrangement of the keyboard 7, 8 enables the user to type with the fingers, which can be freely moved over the keyboard as a result of supporting the heels of the hand on the bar 6. At the same time, the design of the keyboard as a two-part keyboard enables the arms to be suitably positioned for exercising with the arms sufficiently far apart and yet enables all keys to be reached easily. At the same time, the keyboard 7, 8 is preferably a full-fledged QWERTZ keyboard or a QWERTY keyboard as known. In the example shown, not only is the crossbar 6 arranged on the holding arrangement above the column 5, but also a control and display unit 14, 30, 31 of the exercise apparatus. The dividing of the keyboard into the two parts 7 and 8 is likewise advantageous in this case, as the keyboard can be arranged on both sides of this control and display unit 14. With an exercise apparatus 1, in which the control and display unit 14 is arranged differently or the part 14 above the column 5 is omitted, it is possible to use a one-piece keyboard. This is then also arranged on the side of the bar 6 facing away from the exercising arrangement 4.

Preferably, the keyboard 7, 8 is arranged in such a way that it inclines downwards in the sense that the spacebar lies higher than the QWERTZ keys or QWERTY keys. This results in an ergonomic typing position together with the hands supported on the bar 6. It is likewise preferred when the keyboard as a whole keyboard or, as shown, as keyboard parts 7, 8, can be adjusted in height above the floor and therefore also in height compared with the crossbar 6. It can additionally also be mounted so that the keyboard is adjusted in height together with the bar 6 when the height of the bar 6 is adjusted. It is likewise preferred when the mentioned downward inclination of the keyboard is adjustable so that the user can adjust the angle of inclination with respect to the floor. The mounting arrangement which enables the keyboard to be mounted on the holding arrangement of the exercise apparatus, in particular on the column 5, is preferably designed to enable the height and the inclination to be adjusted. The design of such a mounting arrangement for the keyboard is possible for the person skilled in the art in different ways within the scope of his professional knowledge.

With the preferred mounting arrangement shown, a crossbar 23, which runs parallel to the bar 6 and which can be fixed to the column 5 with any mounting means 24 known to the person skilled in the art, is provided. Retaining brackets, which in particular can be fixed around any round column 5, are a possibility for this. Or, special mounting parts which are specifically matched to a particular exercise apparatus 1, or to its column 5, of a particular manufacturer are also a possibility. Brackets 21 and 22 for the keyboard parts, which can be adjusted and fixed in height on the crossbar by means of any fixing means, are provided extending from the crossbar 23. Such fixing means, e.g. with screws and slot guides, are familiar to the person skilled in the art and do not have to be shown in detail here. The arms 21 and 22 are angled at the required inclination and are designed for placing the keyboard parts 7 and 8 on the angled sections of the arms. In particular, a screw fixing or an adhesive fixing can be provided for the keyboard parts. Preferably, a swivel joint which is adjustable and can be fixed in the set position is provided between the vertical part of the arms 21, 22 and the actual angled mounting for the keyboard parts 7 and 8 so that the mentioned inclination of the keyboard or the keyboard parts can be adjusted.

It is also preferred when a touchpad 15 or a trackball is arranged on a bracket 16 above one of the keyboard parts. This allows such input devices to be used without moving the heels of the hands from the supporting position on the bar 6. At the same time, the bracket 16 can likewise be part of the mounting arrangement 21-24 for the keyboard parts or can be a separate fixing. Buttons for controlling the computer can be provided in the usual way on the touchpad or trackball. It is preferred when a support table 18 for the computer 20 is fixed to the column 5, e.g. with supports 17.

In the case of the retrofit solution for equipping an existing exercise apparatus with a one-piece or with a two-piece keyboard 7, 8, these keyboards are provided with mounting arrangements 21-24 which allow the keyboard to be fixed to the exercise apparatus in the described manner. These keyboards are sold for the purpose described together with such a mounting arrangement which is matched to the keyboard and the particular exercise apparatus or with a universal mounting arrangement. At the same time, the mounting arrangement can be suitably designed for a particular exercise apparatus 1 of a particular manufacturer or it can be a universal mounting arrangement which allows the keyboard to be fixed on the side of the bar 6 of the exercise apparatus 1 facing away from the exercising arrangement 4.

Figure 3:
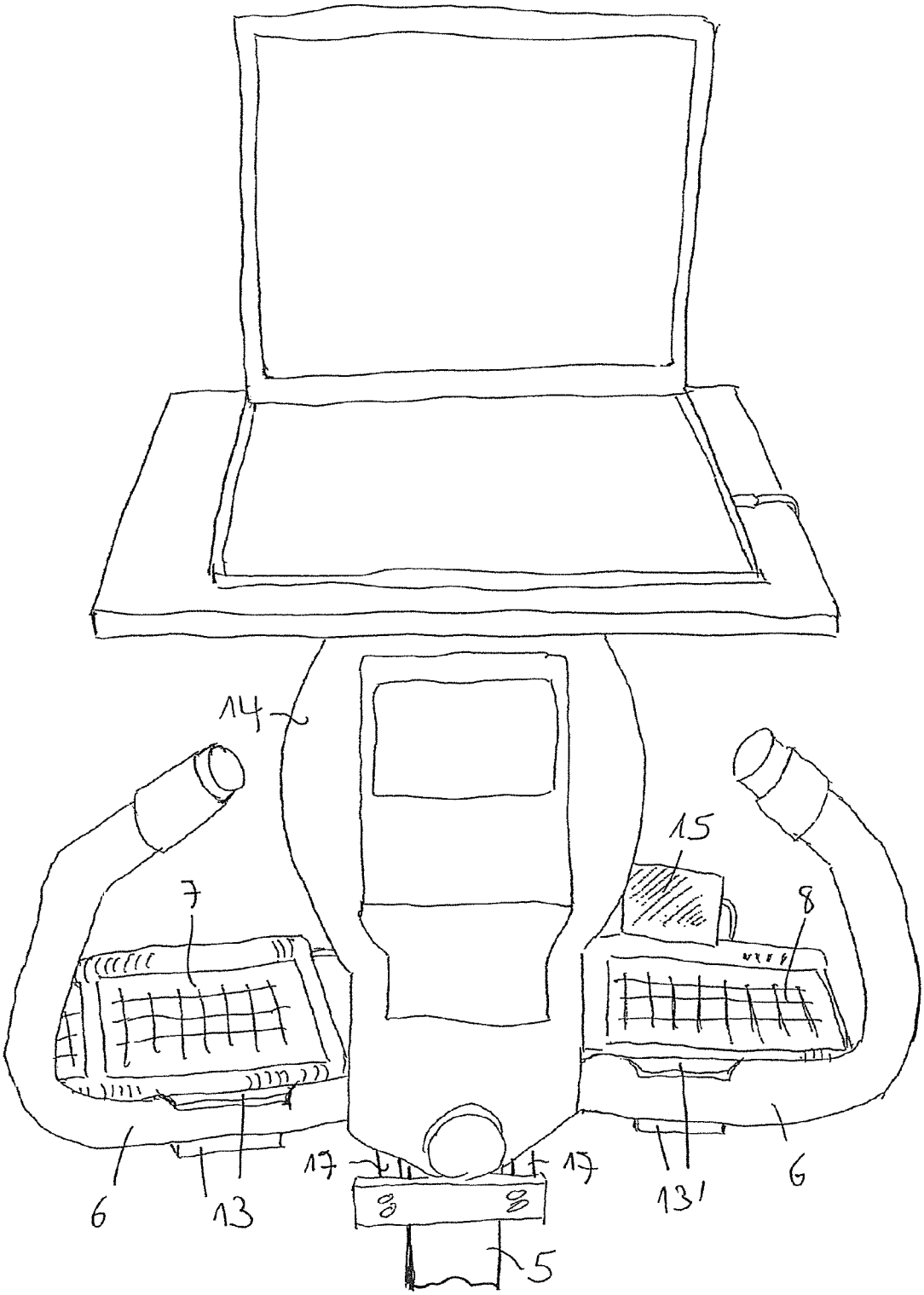
FIG. 3 shows a view as FIG. 2 with a different embodiment of the mounting arrangement of the keyboard.
Figure 4:
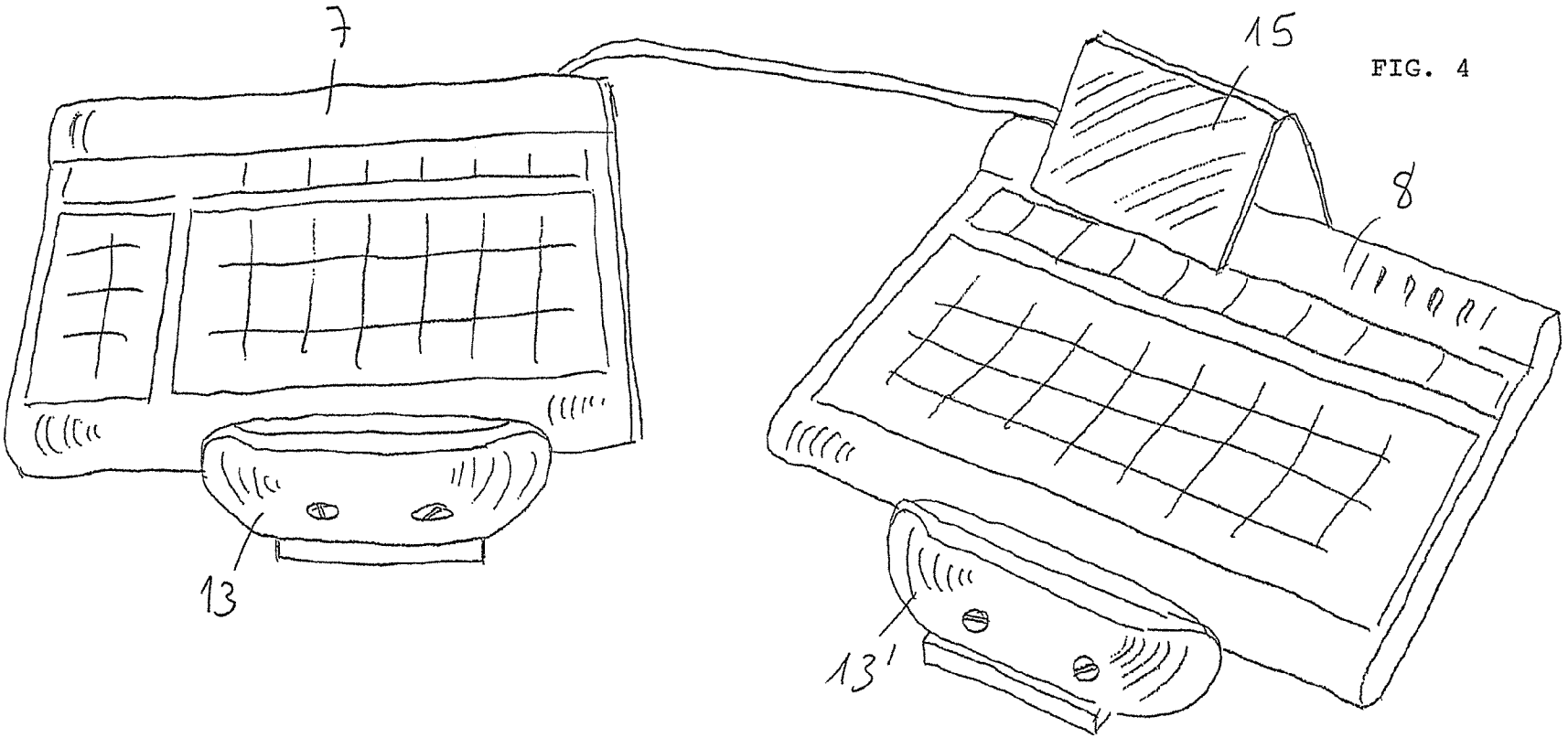
FIG. 4 shows a view on a two-part keyboard with a mounting arrangement with clamping jaws.

A preferred embodiment of the mounting arrangement is shown with the exercise apparatus according to FIG. 3 and with the keyboard according to FIG. 4. Here, the mounting arrangement has clamping jaws 13 and 13', between which the bar 6 can be clamped, for which purpose the respective clamping jaws are first released or loosened by means of screws or other releasable fixing means in order to accommodate the bar 6 and then, after accommodating the bar 6, locked with the screws or fixing means in order to clamp said bar. This results in the keyboard or keyboard parts being fixed to the bar. The inclination of the keyboard can be chosen and adjusted with the clamping jaws loose and then fixed by tightening the clamping jaws. As shown, the clamping jaws 13, 13' may only partially encompass the bar 6 in such a way that the bar 6 continues to directly form the support for the heels of the hands of the person exercising. The clamping jaws 13, 13' can, however, also fully encompass the bar 6 so that the heels of the hands rest on the clamping jaws and are therefore indirectly supported on the bar 6. In this case, the clamping jaws are preferably provided with an elastic overlay which results in the heels of the hands resting comfortably on the clamping jaws.

With an exercise apparatus 1 which has a running surface or a sitting surface 9, a holding arrangement which has a crossbar 6 is provided for the person exercising. In order that clerical work can be carried out on a computer 20 while exercising, a keyboard 7, 8 is arranged so that it comes to lie on the side of the bar 6 facing away from the running surface or sitting surface 9. In particular, it is also inclined downwards. This arrangement of the keyboard enables physical exercise and clerical work to be carried out simultaneously.

The invention claimed is:

1. An exercise apparatus comprising:

a support frame for arranging the exercise apparatus on a floor surface; an exercising arrangement on the support frame having a sitting surface for use by a sitting person or a running surface for use by a standing person;

a holding arrangement defined by the exercising arrangement and having a bar, the longitudinal axis of the bar being arranged at right angles to the longitudinal direction of the exercise apparatus, the bar being arranged for supporting the hands of the person exercising on the exercise apparatus; and a keyboard pivotally mounted on the holding arrangement with a proximate end adjacent the side of the bar facing away from the sitting surface or the running surface, the keyboard being arranged to pivot about the longitudinal axis of the bar to adjusted inclined positions with respect to the horizontal, the proximate end of the keyboard being higher above the floor surface than a distal end of the keyboard in selected inclined positions.

2. The exercise apparatus as claimed in claim 1, in which the keyboard is arranged on the holding arrangement so that its height can be adjusted.

3. The exercise apparatus as claimed in claim 1, in which an input device in the form of a touchpad or a trackball is arranged on the side of the bar facing away from the running surface or sitting surface.

4. The exercise apparatus as claimed in claim 1, in which the exercise apparatus has a saddle as the sitting surface and pedals.

5. The exercise apparatus as claimed in claim 1, in which the exercise apparatus has a treadmill.

6. The exercise apparatus as claimed in claim 2, in which an input device in the form of a touchpad or a trackball is arranged on the side of the bar facing away from the running surface or sitting surface.

7. The exercise apparatus as claimed in claim 2, in which the exercise apparatus has a saddle as the sitting surface and pedals.

8. The exercise apparatus as claimed in claim 2, in which an input device in the form of a touchpad or a trackball is arranged on the side of the bar facing away from the running surface or sitting surface.

9. The exercise apparatus as claimed in claim 3, in which the exercise apparatus has a saddle as the sitting surface and pedals.

10. The exercise apparatus as claimed in claim 2, in which the exercise apparatus has a treadmill.

11. The exercise apparatus as claimed in claim 3, in which the exercise apparatus has a treadmill.

12. The exercise apparatus of claim 1 in which the keyboard is an alphanumeric QWERT keyboard, the selected inclined positions being such that the spacebar of the keyboard comes to lie higher above the floor surface than the QWERT keys of the keyboard.

13. The exercise apparatus of claim 12 in which the keyboard is formed from keyboard halves each of which accommodates a portion of the keys and spacebar, the keyboard halves being arranged separately from one another on the holding arrangement.

14. An alphanumeric keyboard for clerical work, in particular a QWERTZ or QWERTY keyboard which is designed for connecting to a computer and which is arranged on an exercise apparatus having a sitting surface or a running surface and having a holding arrangement that includes a bar, the longitudinal axis of the bar being at right angles to the longitudinal direction of the exercise apparatus, the keyboard being mounted on the holding arrangement such that its height and inclination can be adjusted and a proximate end of the keyboard comes to lie adjacent the side of the bar facing away from the sitting surface or the running surface, wherein the keyboard is arranged to pivot about the longitudinal axis of the bar to inclined positions with respect to the horizontal.

15. The alphanumeric keyboard as claimed in claim 14, in which the keyboard is defined by separate keyboard parts, each of which accommodates a portion of the keys, the mounting arrangement comprising clamping jaws on the keyboard parts for clamping each of the keyboard parts respectively directly to the bar.

16. The use of an alphanumeric keyboard defined by two separate keyboard parts to carry out clerical work while exercising on an exercise apparatus, wherein each keyboard part is pivotally mounted on the exercise apparatus, which exercise apparatus has a sitting surface or a running surface and a holding arrangement, the holding arrangement comprising a bar having a longitudinal axis at right angles to the longitudinal axis of the exercise apparatus for supporting the hands of the person exercising on the exercise apparatus, a proximate end of each keyboard part lying adjacent the side of the bar (6) facing away from the sitting surface or the running surface of the exercise apparatus, each keyboard part being arranged to pivot about the longitudinal axis of the bar to inclined positions with respect to the horizontal.

* * * * *